United States Patent [19]

Garay et al.

[11] Patent Number: 4,800,392

[45] Date of Patent: Jan. 24, 1989

[54] INTEGRAL LAMINAR ANTENNA AND RADIO HOUSING

[75] Inventors: Oscar M. Garay, North Lauderdale; Quirino Balzano, Plantation; Thomas J. Manning, Sunrise, all of Fla.

[73] Assignee: Motorola, Inc., Schaumburg, Ill.

[21] Appl. No.: 1,284

[22] Filed: Jan. 8, 1987

[51] Int. Cl.[4] ..... H01Q 1/38

[52] U.S. Cl. ..... 343/700 MS; 343/702; 343/829

[58] Field of Search ..... 343/700 MS, 702, 795, 343/828–830, 846, 848

[56] References Cited

U.S. PATENT DOCUMENTS

| | | | |
|---|---|---|---|
| 4,054,874 | 10/1977 | Oltman | 343/700 MS |
| 4,123,756 | 10/1978 | Nagata et al. | 343/702 |
| 4,131,893 | 12/1978 | Munson et al. | 343/700 MS |
| 4,356,492 | 10/1982 | Kaloi | 343/700 MS |

FOREIGN PATENT DOCUMENTS

| | | |
|---|---|---|
| 207029 | 12/1986 | European Pat. Off. . |
| 134605 | 7/1985 | Japan . |
| 2046530 | 11/1980 | United Kingdom . |

OTHER PUBLICATIONS

Takeichi, "Unequal-Multiconductor Unipole Antennas", Electronics & Communications in Japan, May 1966, pp. 45–53.

*Primary Examiner*—William L. Sikes
*Assistant Examiner*—Michael C. Wimer
*Attorney, Agent, or Firm*—Martin J. McKinley

[57] ABSTRACT

A laminar antenna includes a conductive ground plane (102), a first dielectric lamina (106), a conductive exciter lamina (108), a second dielectric lamina (114), and a conductive radiator lamina (116). The radiator partially overlaps the exciter and the amount of overlap determines the input impedance of the antenna. The laminar antenna can be positioned within the wall of a plastic radio housing (302). Multi-radiator wideband and duplex embodiments of the antenna are also described. In another embodiment, the ground plane extends above the radio housing while the radiator and dielectric laminae wrap around the extended portion of the ground plane.

1 Claim, 4 Drawing Sheets

INTEGRAL LAMINAR ANTENNA AND RADIO HOUSING

BACKGROUND OF THE INVENTION

Portable radio transceivers typically include a one-quarter wavelength end-fed, helical, or one-half wavelength center-fed dipole antenna that protrudes from the radio housing. The antenna is usually flexible in design to prevent damage, not only to the antenna itself, but also to any person who may come into contact with the antenna. A connector typically attached the antenna to the radio housing so that the antenna can be easily removed from the radio.

There are several drawbacks to these prior art antenna designs. First, because the antenna protrudes from the housing, it extends the overall length of the radio, making the radio more cumbersome. The flexible design and connector make the antenna expensive to manufacture, and repeated flexing of the antenna over an extended period of time can result in breakage. These prior art antennas also typically require some type of impedance matching network between the final R.F. power amplifier and the antenna.

Accordingly, it would be desirable if an antenna could be developed which has a very low profile such that it could be mounted in or on the radio housing without protrusion. It would also be desirable to eliminate the impedance matching network and reduce the manufacturing cost of the antenna. It would be advantageous, however, to approximate the radiation pattern of the prior art center-fed dipole antenna.

SUMMARY OF THE INVENTION

Briefly, the invention is a laminar antenna that includes a plurality of laminae superposed one another in the following order: conductive ground plane lamina, a first dielectric lamina, a conductive exiter lamina, a second dielectric lamina, and a conductive radiator lamina that partially overlaps the exciter lamina.

In another embodiment, the invention is an integral radio housing and laminar antenna that includes a radio housing having a wall with first and second surfaces. A laminar antenna is positioned between the first and second surfaces of the housing wall. The laminar antenna includes a plurality of laminae superposed one another in the following order: a conductive ground plane lamina, a first dielectric lamina, a conductive exciter lamina, a second dielectric lamina, and a conductive radiator lamina partially overlapping the exciter lamina.

A wideband embodiment of the laminar antenna includes a plurality of laminae superposed one another in the following order: a conductive ground plane lamina, a first dielectric lamina, a conductive exciter lamina, a second dielectric laminae, and a plurality of coplanar conductive radiator laminae partially overlapping the exciter lamina. Each of the radiator laminae are of a different electrical length whereby a substantially flat bandwidth is provided from the lowest resonant frequency of the longest radiator to the highest resonant frequency of the shortest radiator.

A duplex embodiment of the laminar antenna for simultaneously transmitting and receiving includes a plurality of laminae superposed one another in the following order: a conductive ground plane lamina, a first dielectric lamina, a conductive exciter lamina, a second dielectric lamina, and transmit and receive coplanar conductive radiator laminae each of which partially overlaps the exciter lamina. The trasmit and receive radiators are resonant respectively at transmit and receive frequencies. Substantial isolation is provided between the transmit and receive frequencies.

DESCRIPTION OF THE PREFERRED EMBODIMENT

In the following description, dimensions will be given for an exemplary embodiment of a single radiator laminar antenna which is resonant at 450 MHz. Using the teachings of the exemplary embodiment, those skilled in the art will understand how to construct a similar antenna that is resonant at any other frequency.

Figure 1:
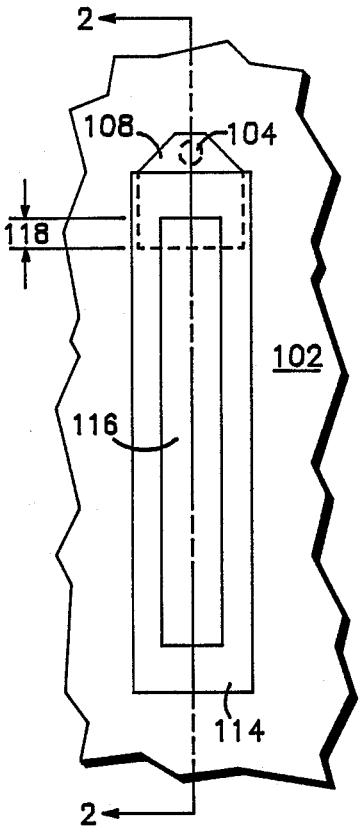
FIG. 1 is a plan view of a single radiator embodiment of the laminar antenna.
Figure 2:
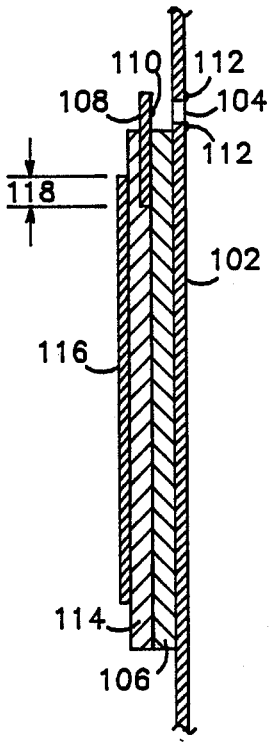
FIG. 2 is a sectional view of the laminar antenna as seen along line 2—2 of FIG. 1.

In FIGS. 1 and 2, plan and sectional views of the single radiator antenna are respectively illustrated. Referring to these figures, a conductive ground plane lamina 102, preferably a thin sheet of copper, has a hole 104 suitable for receiving a coaxial trasmission line (not illustrated. A first dielectric lamina 106 (visible only in FIG. 2) is superposed on ground plane 102. An exciter lamina 108, also preferably a thin copper sheet, is superposed on first dielectric lamina 106. Exciter 108 has a terminal 110 for connection to the center conductor of a coaxial transmission line while ground plane 102 has a terminal 112 for connection to the shield of the transmission line. The transmission line is preferably soldered to terminals 110 and 112.

A second dielectric lamina 114 is superposed on exciter 108. It should be evident from FIG. 2 that exciter 108 does not extend the full length of the antenna. Thus, below exciter 108, second dielectric lamina 114 is actually superposed on first dielectric lamina 106. Dielectric laminae 106 and 114 are constructed from Barium Neodymium Titanate, are 80 mm long by 12 mm wide, and are respectively 2 mm and 1 mm thick.

Radiator lamina 116 is superposed of dielectric lamina 114 and 61.7 mm long by 10 mm wide. For resonance at other frequencies, the electrical length of radiator 116 should be one-half wavelength, taking into account the dielectric constant of laminae 106 and 114 (the dielectric constant of Barium Neodymium Titanate is 92). The use of a high dielectric constant material shortens the physical length of radiator 116, however, the Q of the antenna will also be higher (i.e., narrower bandwidth). The thickness of conductive laminae 102, 108 and 116 should be at least three skin depths at the desired operating frequency. The overlap 118 of radiator 116 and exciter 108 can be adjusted to match impedance of the antenna at terminals 110 and 112) to the impedance of the transmission line. As a general rule, the greater the overlap, the lower the antenna impedance. In the 450 MHz example, overlap 118 is approximately 1 mm and the antenna impedance is 50 Ohms.

Figure 3:
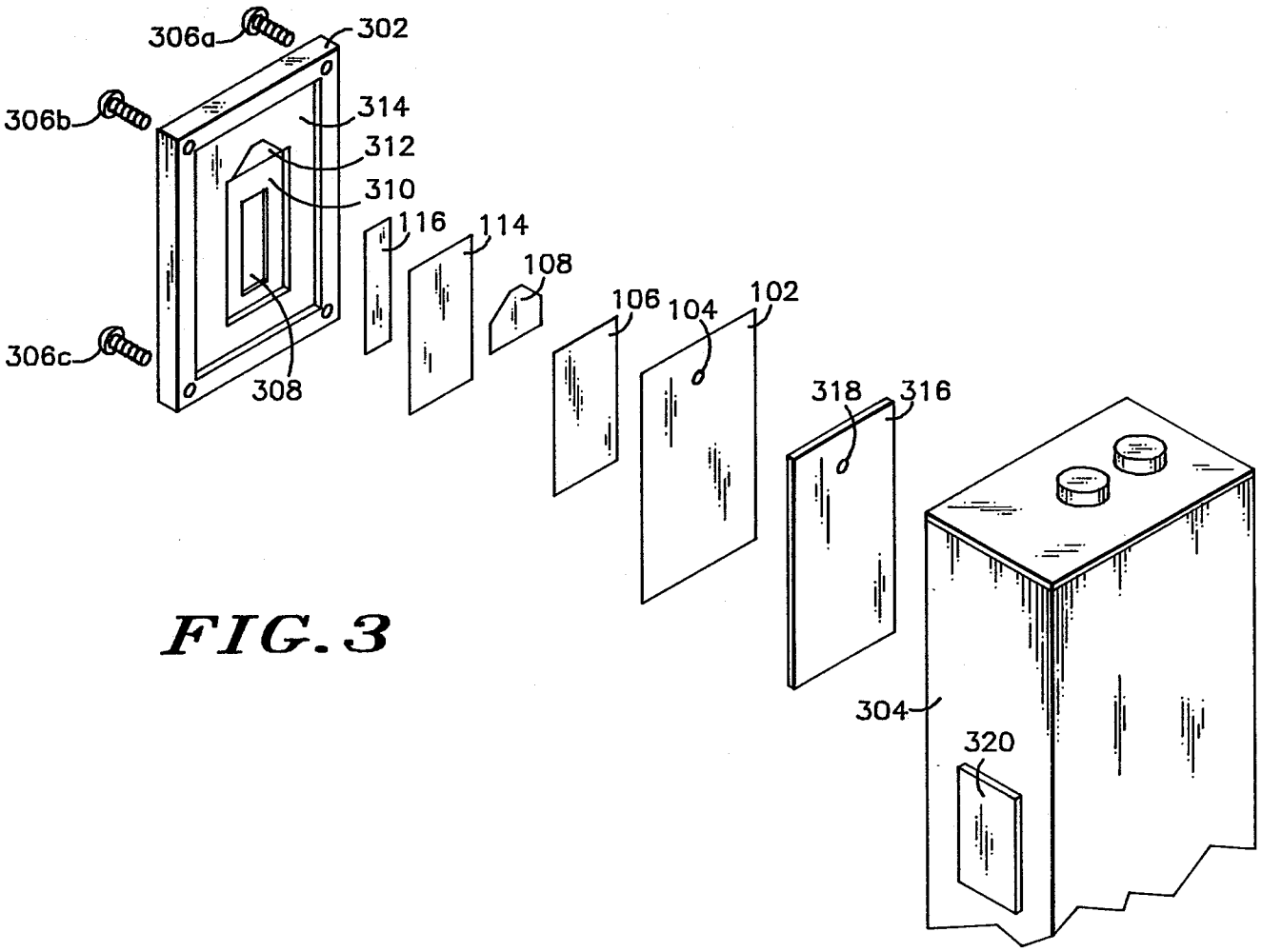
FIG. 3 is an exploded perspective view of an integral radio housing and laminar antenna.

Because the laminar antenna is not much more than 3 mm thick, it can be incorporated into the wall of a radio housing. FIG. 3 illustrates how the previously described single radiator laminar antenna can be constructed into the cover of a radio housing. Referring to this figure, a housing cover 302 covers an opening on the rear of radio housing 304 and is secured thereto by screws 306*a* through 306*d* (306*d* is not visible in FIG. 3). Cover 302 and housing 304 are preferably molded from polycarbonate plastic, although other materials may also be suitable. On the inside of cover 302 are molded recesses 308, 310, 312 and 314 which are suitable for receiving radiator 116, dielectric laminae 106 and 114, exciter 108, and ground plane 102 respectively. A cap 316, preferably a thin sheet of polycarbonate, is also positioned in recess 314 and is preferably ultrasonically welded to cover 302. After assembly, the laminar antenna is completely contained between the inner and outer surfaces of rear cover 302. A hole 318 in cap 316 accepts a coaxial transmission line to connect the antenna to the radio circuitry contained in housing 304. Other methods for positioning the laminar antenna within the walls of the housing are also possible. For example, the laminar antenna could be molded into one wall of radio housing 304.

Radio housing 304 also contains a push-to-talk (PTT) switch 320. Note that PTT switch 320 is positioned below the laminar antenna such that when the user's hand activates the switch, the hand does not cover the antenna.

Figure 4:
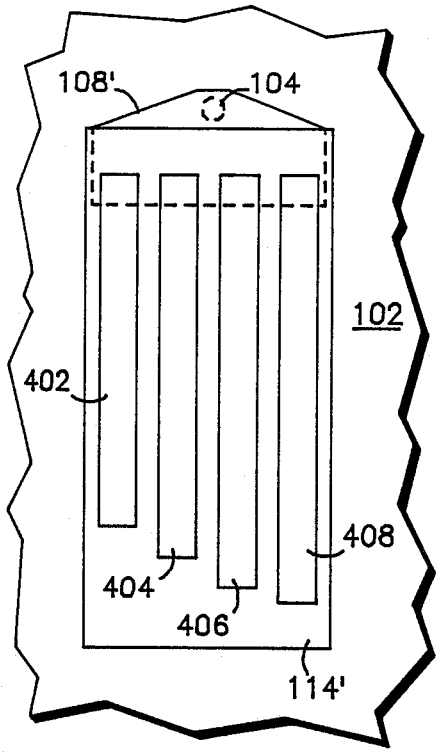
FIG. 4 is a plan view of a widened embodiment of the laminar antenna.

In FIG. 4, a plan view of a wideband embodiment of the laminar antenna is illustrated. This antenna is similar in design to the single radiator embodiment of FIGS. 1 and 2, however, the wideband embodiment has a plurality of radiators 402, 404, 406 and 408. First and second dielectric laminae 106' and 114' (106' is not visible in FIG. 4), and exciter 108' are respectively similar to dielectric laminae 106 and 114, and exciter 108 of FIGS. 1 and 2, except, their widths have been increased to accommodate more than one radiator.

The electrical lengths of radiators 402, 404, 406 and 408 are selected such that a substantially flat frequency response occurs between the lowest usuable frequency of element 408 (the longest radiator) and the highest usable frequency of element 402 (the shortest radiator). The spacing between adjacent radiators should be at least twice the distance between the radiator and ground plane 102. Although a four radiator embodiment is illustrated in FIG. 4, the concept can be extended to any reasonable number of radiators. As in FIGS. 1 and 2, the overlap of the radiators and the exciter adjusts the input impedance of the antenna.

Figure 5:
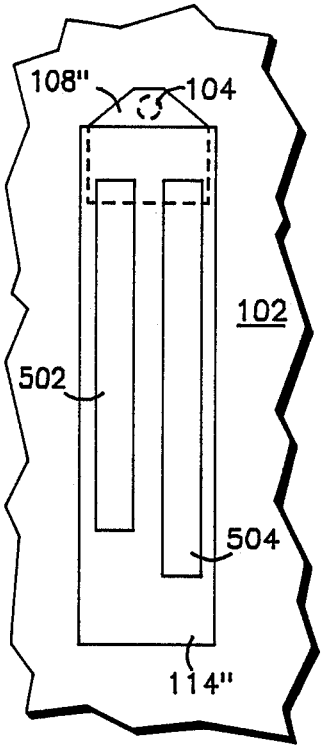
FIG. 5 is a plan view of a duplex embodiment of the laminar antenna.

In FIG. 5, a duplex embodiment of the laminar antenna is illustrated. This embodiment permits duplex operation (simultaneous reception and transmission) on two closely spaced receive and transmit frequencies while providing some isolation between the transmitter and receiver circuits. An example will be described that is suitable for use in the 900 MHz cellular telephone band. In this particular embodiment the dielectric laminae 106" and 114" (only 114" is visible in FIG. 5) are constructed from 99% alumina ceramic which has a dielectric constant of approximately 10. First and second dielectric laminae 106" and 114" are 2 mm and 0.6 mm thick respectively. A first radiator 502 is 66.5 mm long by 7.5 mm wide and is resonant at 938 MHz. A second radiator 504 is 70 mm long by 7.5 mm wide and is resonant at 899 MHz. Measuring the band edges at the 10 dB return loss points, first radiator 502 has a band width of 935 to 941 MHz while second radiator 504 has a bandwidth of 896 to 902 MHz. As in the single radiator embodiment, the overlap of the radiators and exciter 108" is approximately 1 mm. For duplex operation on transmit and receive frequencies split by 45 MHz, approximately 30--40 dB of isolation is provided between the two radiators.

The previously described antenna embodiments have a cardiod shaped radiation pattern. The total radiation loss with respect to a one-half wavelength dipole in free space at face level is about 2 dB. When the radio is placed at belt level (about 5 cm from the user's body) the laminar antenna out performs the half wavelength dipole by 7 dB. Since the laminar antenna is fed parallel to a ground plane, it is not disturbed by the presence of a large conductor.

Figure 6:
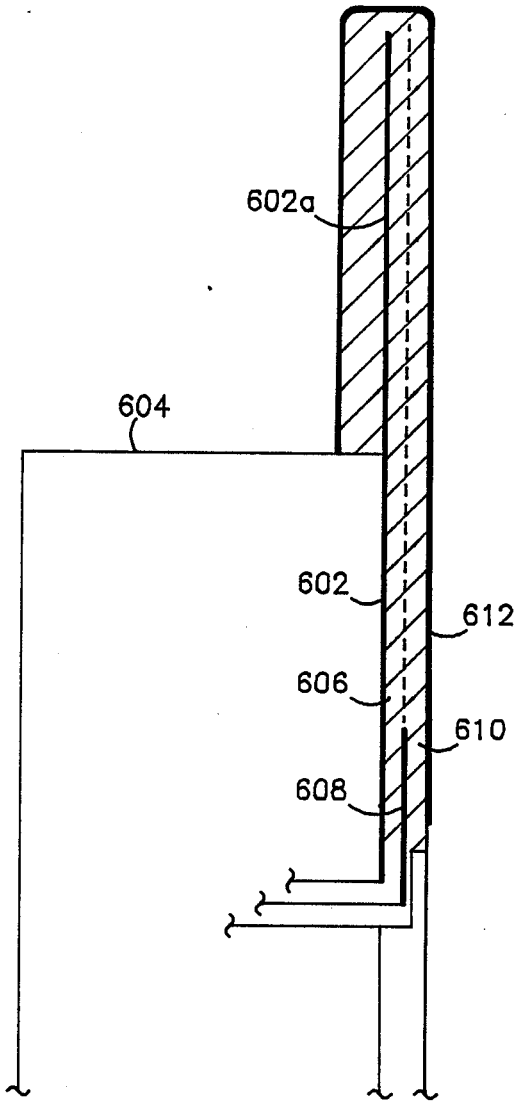
FIG. 6 is a sectional view of another embodiment of the laminar antenna.

The radiation pattern of the antenna can be altered to more closely approximate that of a half wavelength dipole by using the antenna embodiment illustrated in FIG. 6. Referring to this figure, ground plane 602 is simlilar to ground plane 102, however, a one-quarter wavelength section of the ground plane extends above the radio housing 604. First and second dielectric laminae 606 and 610, exciter 608, and radiator 612 are similar in design to those previously described. However, the dielectric laminae and radiator 612 wrap around the protruding end 602a of ground plane 602 and continue until they meet radio housing 604. This embodiment of the antenna radiates on both sides of ground plane 602, however, it does protrude from the radio housing by one-quarter wavelength.

We claim as our invention:

1. A laminar antenna, comprising in combination:

a substantially flat conductive ground plane lamina having first and second surfaces;

a first dielectric lamina superposed said first surface, wrapping around an end of said ground plane lamina, and superposing a portion of said second surface of said ground plane lamina;

a second dielectric lamina superposed said first dielectric lamina, and extending over said first surface of said ground plane lamina, wrapping around said end of said ground plane lamina and extending over said second surface of said ground plane lamina;

a conductive exciter lamina positioned between said first and second dielectric laminae; and a radiator lamina superposed said second dielectric lamina and extending over said first surface of said ground plane lamina, wrapping around said end of said ground plane lamina and extending over a portion of said second surface of said ground plane lamina.

* * * * *